US006331024B1

(12) United States Patent
Gulley

(10) Patent No.: US 6,331,024 B1
(45) Date of Patent: Dec. 18, 2001

(54) LIFTING SLING SYSTEM WITH SPACED, BI-DIRECTIONAL LOOPS

(76) Inventor: William F. Gulley, 200 Duff Rd. Ext., Monroe, LA (US) 71203

( * ) Notice: Subject to any disclaimer, the term of this patent is extended or adjusted under 35 U.S.C. 154(b) by 0 days.

(21) Appl. No.: 08/972,761

(22) Filed: Nov. 18, 1997

(51) Int. Cl.[7] ..... B66C 1/12
(52) U.S. Cl. ..... 294/74
(58) Field of Search ..... 294/74–76, 82.11, 294/82.14, 149, 152, 156; 224/103; 59/79.1, 93

(56) References Cited

U.S. PATENT DOCUMENTS

| | | | | |
|---|---|---|---|---|
| 1,222,048 | * | 4/1917 | Sunderland | 294/74 |
| 1,548,190 | | 8/1925 | Cronqvist . | |
| 2,357,182 | | 8/1944 | Farmer . | |
| 2,508,795 | | 5/1950 | Nielsen . | |
| 3,592,502 | | 7/1971 | Bolliger . | |
| 3,611,709 | | 10/1971 | Bilbey . | |
| 3,701,559 | | 10/1972 | Marino et al. . | |
| 3,840,262 | | 10/1974 | Foster et al. . | |
| 4,209,044 | * | 6/1980 | Taki | 294/74 |
| 4,239,271 | | 12/1980 | Beasley et al. . | |
| 4,240,659 | * | 12/1980 | St. Germain | 294/74 |
| 4,431,226 | | 2/1984 | Weilket . | |
| 4,441,748 | | 4/1984 | St. Germain . | |
| 4,737,069 | | 4/1988 | Coblentz . | |
| 4,834,439 | | 5/1989 | van de Kamp . | |
| 4,856,836 | | 8/1989 | Delphin . | |
| 4,993,769 | | 2/1991 | Chapalain . | |
| 5,238,279 | * | 8/1993 | Anteau | 294/74 |
| 5,308,101 | | 5/1994 | Monty . | |

FOREIGN PATENT DOCUMENTS

| | | |
|---|---|---|
| 952210 | 3/1964 | (DE) . |
| 2583030 | 12/1986 | (FR) . |
| 1516445 | 10/1989 | (SU) . |

* cited by examiner

*Primary Examiner*—Dean J. Kramer
(74) *Attorney, Agent, or Firm*—Pugh/Associates, Patent & TM Attorneys; C. Emmett Pugh

(57) ABSTRACT

A sling (10, 10', FIGS. 1–3) for lifting a heavy work piece (e.g. a pipe section; FIGS. 5, 6), including a single strap made of flexible, in-elastic fabric material over-lappingly converging upon itself to form a top strap member and a bottom strap member to form a two-ply strap member; a first, integral, eye-loop end; a second, integral eye-loop end; at least one, intermediately spaced, bi-directional loop (50, 150*a–d*) coupled to the two-ply strap member between the first and second, eye-loop ends. Each bi-directional loop serves to distribute suspension stresses in two directions, longitudinally, along the lifting sling when used to complete the closed lifting loop and distribute pulling forces in either of two directions, longitudinally, along the sling when pulled in any or either longitudinal direction. Additionally, since crane time is very expensive to operate, a sling system which can accommodate the lifting of a plurality of heavy pipes or other heavy objects simultaneously is provided (FIGS. 8–7).

18 Claims, 5 Drawing Sheets

LIFTING SLING SYSTEM WITH SPACED, BI-DIRECTIONAL LOOPS

REFERENCE TO RELATED APPLICATION

The present invention relates to some of the same subject matter as previously filed, application by the same inventor, namely, U.S. patent application Ser. No. 08/497,548, filed Jun. 30, 1995, being issued as U.S. Pat. No. 5,688,011 on Nov. 18, 1997, the entire specification of which is incorporated herein by reference as if set forth in full below.

TECHNICAL FIELD

The present invention relates to slings for holding, lifting or otherwise manipulating a heavy load or other heavy object, and in particular to slings constructed of fabric (e.g. nylon) strapping material having a plurality of spaced bi-directional loops used in connection with, for example, one or more connecting shackles or other means of fastening, for use with loads of various sizes. An exemplary pipe load with which the invention is used typically weighs, for example, hundreds of pounds or greater. Furthermore, the sling of the present is capable of suspending therefrom simultaneously a plurality of heavy pipe loads or other heavy objects. The invention also relates to sling use methodology and methods of manufacturing slings.

BACKGROUND ART

Slings for lifting and carrying heavy pipes or other like heavy objects are known. However, the known slings do not prevent longitudinal twisting and turning of the sling as the heavy pipes or other objects are suspended in mid-air via a closed lifting loop. Moreover, known slings do not provide bi-directional loops which serve to distribute suspension stresses in two directions, longitudinally, along the length or longitudinal axis of the sling when used to complete the closed lifting loop and distribute pulling forces in two directions, longitudinally, along the sling when pulled in any direction. Furthermore, since crane time is very expensive to operate, it is highly desirable to provide a sling system which can accommodate the lifting of a plurality of heavy pipes or other heavy objects simultaneously.

A list of prior patent references which may be of interest is provided below:

| Patent No. | Inventor | Issue Date |
|---|---|---|
| 1,548,190 | Cronqvist | 08/04/25 |
| 2,357,182 | Farmer | 08/29/44 |
| 2,508,795 | Nielsen | 05/23/50 |
| 3,592,502 | Bolliger | 07/13/69 |
| 3,611,709 | Bilbey | 10/12/71 |
| 3,701,559 | Marino et al. | 10/31/72 |
| 3,840,262 | Foster et al. | 10/08/74 |
| 4,239,271 | Beasley et al. | 12/16/80 |
| 4,431,226 | Weilert | 02/14/84 |
| 4,441,748 | St. Germain | 04/10/84 |
| 4,737,069 | Coblentz | 04/12/88 |
| 4,834,439 | van de Kamp | 05/30/89 |
| 4,856,836 | Delphin | 08/15/89 |
| 4,993,769 | Chapalain | 02/19/91 |
| 5,308,101 | Monty | 05/03/94 |
| 952,210 (GER) | | 03/11/64 |
| 1,516,445 (SU) | Volzhsk | 10/23/89 |
| 2,583,030 (FR) | Baroux | 12/12/86 |

In the "sling" art it is known to use a strap of woven or flexible material with loops formed at the terminal ends of the strap; note, for example, the U.S. Pat. No. 3,592,502 patent to Bolliger of Sweden issued in 1971, and the U.S. Pat. No. 4,239,271 patent to Beasley et al issued in 1980.

The Monty patent (U.S. Pat. No. 5,308,108) is directed to an elastic towing strap including an elongated strap having coupled thereto a heavy duty fabric material longer than the non-stretched length of the elastic strap.

The Chapalain patent (U.S. Pat. No. 4,993,769) is directed to a strap having coupled to one end thereof a shackle.

The van de Kamp patent (U.S. Pat. No. 4,834,439) teaches the use of a closed sling of textile webbing material for load lifting which includes four "lifting loops" formed by four slots at greatly spaced locations along of its length, with the closed length webbing material forming four lobes somewhat similar to a four leaf clover. The "lifting loops" are located at the four corners of the cloverleaf lobes into which loops four, converging crane hooks are placed to lift a rectangular, box-like, stacked load carried by the sling. The inner sides of the loops are engaged by oppositely directed, diagonally disposed, tie loops. Although pertinent to the invention, the "loops" and sling of van de Kamp are quite different in structure and use from the sling and sling system of the present invention.

The patent to Coblentz (U.S. Pat. No. 4,737,069) is directed to a method of transporting luggage using a strap having a U-shaped configuration forming first and second end portions. The first and second end portions have coupled thereto a top cross strap and an intermediate cross strap. Furthermore, each end of the first and second end portions forms an end loop.

The Marino et al. patent (U.S. Pat. No. 3,701,559) discloses a sling including four loops having a generally cloverleaf configuration to lift a rectangular, box-like, stacked load carried by the sling.

The French patent document 2,583,030 of Baroux (1980) is directed to a sling for handling a bundle having a continuous, closed member having a supplemental "clamping strap" which is tied across to a loop to enclose the bundle for lifting. There is thus only a single loop along the length of the closed member and the effective diameter is determined by how much of the "clamping strap" is left untied to the loop. This approach likewise is substantially different in structure and use from the present invention.

The nylon sling assembly of Joseph Delphin disclosed in the U.S. Pat. No. 4,856,836 patent uses two straps, each with a variable diameter, end loop, to engage rounded or cylindrical objects useful in the off-loading of cargo to and from an offshore well platform. The loops include above them choker sleeves which slide up and down on the straps to open and close the effective diameters of the loops.

The St. Germain patent (U.S. Pat. No. 4,441,748) is directed to strip thimble for covering a flexible metal cable sling. The strip thimble comprises a fabric strip which includes at least three (3) plies of woven webbing. The strip thimble is coupled to the cable by means of eight (8) spaced friction straps having end portions which are secured between the plies. The straps ends do not extend in a direction parallel to the longitudinal surface of the fabric strip, as does the strap ends of the bi-directional loops of the present invention. Furthermore, the straps are used as a means to maintain the cable within the strip thimble which is substantially different than the present invention.

The Foster et al. patent (U.S. Pat. No. 3,840,262) is directed to a pipe sling having spaced end members with fabric belting material wrapped back and forth between the end members.

The patent to Bilbey (U.S. Pat. No. 3,611,709) issued in 1971 shows the use of the links of the chain as a connecting area for a hook or other type connector.

The patent to Weilert (U.S. Pat. No. 4,431,226) is directed to a large mattress carrying device having a variably adjustable wrap-around band.

The patent to Nielsen (U.S. Pat. No. 2,508,795) is directed to a mattress harness having coupled thereto handle members. The mattress harness is secured around a mattress via a buckle.

The Farmer patent (U.S. Pat. No. 2,357,182) shows a sling which includes a pair of crossed cords or ropes provided with means whereby the ends may be detachably connected together.

The Cronqvist patent (U.S. Pat. No. 1,548,190) is directed to a spar-tree strap having a plurality of links which is essentially made of a steel cable. Each distal end of a link has secured thereto an eye for receiving therethrough adjacent links to form a strap around a tree in a closed loop manner.

The Russian Patent (1,516,445) by Volzhsk is directed to a sling having a rope with a clasping device. Around the rope are loops formed by the attachment of short lengths of additional rope to the main rope by clamps.

The British Patent No. 952,210 published Mar. 11, 1964, is directed to lifting belts for use in righting de-railed vehicles. The lifting belt comprises a wire rope bent into a U-shape forming two substantially parallel portions which are connected together at intervals along their lengths by U-shaped wire-rope cross members.

As can be readily seen, there is a continuing need to provide a sling with at least one bi-directional loop or a plurality of bi-directional loops which serve to distribute suspension stresses in two directions, longitudinally, along the lifting straps when used to complete the closed lifting loop and distribute pulling forces in two directions, longitudinally, along the sling when pulled in any direction. Furthermore, since crane time is very expensive to operate, it is highly desirable to provide a sling system which can accommodate the lifting of a plurality of heavy pipes or other heavy objects simultaneously. As will be seen more fully below, the present invention is substantially different in structure, methodology and approach from that of the prior art slings.

GENERAL SUMMARY DISCUSSION OF INVENTION

The sling of the present invention is designed to be used, for example, in existing areas where head room and material to rig from is a problem, particularly for use with very heavy loads, such as, for example, heavy pipe. An exemplary pipe load with which the invention can be used typically weights, for example, hundreds of pounds.

The preferred sling for lifting a work piece of the present invention, comprises—a single strap made of flexible, in-elastic fabric material over-lappingly converging upon itself to form a top strap member and a bottom strap member to form a two-ply strap member; a first eye-loop end; a second eye-loop end; at least one spaced bi-directional loop coupled to the two-ply strap member between the first eye-loop end and the second eye-loop end.

The preferred sling of the present invention further includes an attachment means, such as a shackle, for selectively attaching the first eye-loop end to said at least one bi-directional loop, wherein the attachment means having a first portion disposed through said at least one bi-directional loop and the first eye-loop end is attached to said at least one bi-directional loop.

The preferred method of lifting a work piece using the sling of the present invention comprising the steps of—(a) providing a sling comprising a single strap made of flexible, in-elastic fabric material over-lappingly converging upon itself to form a top strap member and a bottom strap member to form a two-ply strap member; a first eye-loop end; a second eye-loop end; and at least one spaced bi-directional loop coupled to the two-ply strap member between the first eye-loop end and the second eye-loop; and an attachment means for selectively attaching the first eye-loop end to said at least one spaced, bi-directional loop; (b) wrapping the first eye-loop end about the work piece in a manner such that a top side of the top strap member is in surface-to-surface contact with the work piece; (c) attaching the first eye-loop end to said at least one spaced, bi-directional loop with the attachment means to form a closed lifting loop; and (d) exerting a force on the strap sufficient to lift the work piece.

The preferred method of the present invention for lifting a work piece via the sling utilizes a number of bi-directional loops each of which are spaced a predetermined distance from the first eye-loop end in a manner such that the sling may be placed snugly about a variety of different sized work pieces wherein each bi-directional loop serves to distribute suspension stresses in two directions, longitudinally, along the sling when used to complete a closed lifting loop and distribute pulling forces in two directions, longitudinally, along the sling when pulled in any direction; and wherein there is further included the step of—selecting one of the number of bi-directional loops which produces the closed lifting loop having a comparable inner diameter in comparison to the outer periphery of the work piece being worked on.

The currently preferred method of manufacturing of the present invention for the preferred sling of the present invention comprises the steps of (a) providing a single strap having a first length defined between a first end and a second end; (b) over-lappingly converging a portion of the first length of the single strap upon itself to form a top strap member and a bottom strap member wherein the first end and the second end are in close proximity; (c) forming a first eye-loop end; (d) forming a two-ply end region adjacent the first eye-loop end having a first predetermined length; (e) distributing at least one bi-directional loop between the two-ply end region and the three-ply end region wherein the distance between the first eye-loop end and the at least one bi-directional loop has a length capable of wrapping around a work piece having a circumference; (f) forming a second eye-loop wherein the second end is looped wherein a portion of the top strap member is sandwiched between a portion of the top strap member and a portion of the second strap member and wherein the formation of the second eye-loop forms a three-ply end region having a predetermined length; and (g) securing the top strap member and the bottom strap member having coupled thereto the at least one bi-directional loop.

The preferred method step "c" of manufacturing of the present invention further comprises the sub-steps of—(i) folding the width of the portion of the single strap forming the first eye-loop end essentially in half; and (ii) securing the folded portion of the first eye-loop end together to form a two-ply first eye-loop end; and the preferred method step "f" further comprises the sub-steps of—(i) folding the width of the portion of the single strap forming the second eye-loop end essentially in half; and (ii) securing the folded portion of the second eye-loop end together to form a two-ply second eye-loop end.

The preferred distributing step "e" of the method of manufacturing of the present invention comprises the sub-steps of—(i) providing a first strap member having a width which is half the width of the single strap; (ii) providing a second strap member having a width which is half the width of the single strap; (iii) arching the first strap member to form ends having a predetermined length and an arch portion; (iv) arching the second strap member to form ends having a predetermined length and an arch portion; (v) overlapping, parallelly, the arch portion of the first strap member and the arch portion of the second strap member; (vi) securing together the overlapping, parallelly, arch portion of the first strap member and the arch portion of the second strap member to form a two-ply closed loop member; (vii) sandwiching the ends of the first strap member and the ends of the second strap member between the top strap member and the bottom strap member; (viii) looping the two-ply closed loop member over a top side of the top strap member; and (ix) securing the ends of the first strap member and the ends of the second strap member to the top strap member and the bottom strap member.

The preferred step of sandwiching "vii" of the method of manufacturing comprises the sub-steps of—(a1) parallelly aligning the ends of the first strap member in side-by-side parallel alignment with each other in a first direction wherein the longitudinal length of the ends of the first strap member are parallelly aligned with the top strap member and the bottom strap member; and (a2) parallelly aligning the ends of the second strap member in side-by-side parallel alignment with each other in a second direction wherein the longitudinal length of the ends of the second strap member are parallelly aligned with the top strap member and the bottom strap member.

The preferred sling of the present invention comprises a sling which is uniquely constructed with a plurality of spaced, three-ply fabric regions wherein any two adjacent three-ply fabric regions are separated by two-ply fabric regions to maximize the control of a heavy pipe or other heavy load while providing a sling adaptable to the all pipe circumferences desired, with standard sizes made for "off-the-shelf" availability.

The preferred sling of the present invention comprises first and second eye-loop ends wherein the sling strap member from the first eye-loop end forms a two-ply end region having a first predetermined length and the sling strap member from the second eye-loop end forms a three-ply end region for a second predetermined length. Such two-ply end region is sufficiently flexible to easily wrap such region around the circumference of a heavy pipe or other heavy load so that the first eye-loop end can be coupled to one of the plurality of bi-directional loops to form a closed lifting loop. The three-ply end portion is flexible but sufficiently rigid to prevent longitudinal twisting and turning of the three-ply end portion when the second eye-loop end is coupled to a lifting device to suspend the sling and heavy pipe or other heavy object in mid-air.

The preferred sling of the present invention comprises a plurality of spaced bi-directional loops for coupling in any one of the bi-directional loops a connecting shackle or other means of fastening used to secure the sling of the present invention around the varying, circumferential, outer perimeters of the heavy pipe or other heavy load. The stress of suspension exerted on the bi-directional loop having coupled thereto the first eye-loop end via a shackle, as a heavy pipe or other heavy load is secured in the closed lifting loop and suspended in mid-air via a lifting device, is distributed in two opposite directions, longitudinally, along the sling.

The plurality of bi-directional loops along the length of the sling between the closed lifting loop and the second eye-loop end can be hooked via a second lifting device to pull the sling in a desired direction. As the second lifting device pulls the sling in the desire direction, the bi-directional loop, from which the sling is being pulled, distributes the pulling forces exerted thereto into two opposite directions, longitudinally, along the sling, thereby maneuverability of the heavy pipe or other heavy load, while suspended, in different directions, i.e., side-to-side, up or down, is enhanced.

The plurality of spaced, three-ply fabric regions between the closed lifting loop and the second eye-loop end significantly reduces the ability of the sling strap member of the present invention to longitudinally twist and turn in each of the three-ply fabric regions. Nevertheless, each of the three-ply fabric regions maintains a sufficient degree of flexibility to conform such three-ply fabric to the circumferential outer perimeter of a heavy pipe or other heavy load, when necessary. However, the reduced ability of the sling strap member to twist and turn in such three-ply fabric regions maximizes the control of the heavy pipe or other heavy load when suspended in mid-air via the sling system of the present invention.

The plurality of spaced two-ply fabric regions of the sling are sufficiently flexible to provide the necessary flexibility to contour the more rigid (while slightly flexible) three-ply fabric regions around varying circumferential, outer perimeters of the heavy pipe or other heavy load. The distance between a two-ply fabric region and an adjacent three-ply fabric regions is preferably shorter than the length of the three-ply fabric regions.

Each bi-directional loop comprises a first strap member looped into an arch shape and a second strap member looped into an arch shape, wherein the ends of the first strap member and the ends of the second strap member extend in opposite directions longitudinally along the two-ply sling strap member and are sandwiched between the top strap member and the bottom strap member of the two-ply sling strap member. The arch portion of the first strap member and the arch portion of the second strap member overlap upon the top side of the sling strap member in close proximity to the other, such that the arch portion of the first strap member and the arch portion of the second strap member are overlappingly secured together to form a two-ply, closed, arch loop member.

The two-ply strap member is preferably a single strap made of an in-elastic fabric material, preferably one made of nylon fibers. The single strap may be formed from one or more layers of woven strapping material.

The first strap member and the second strap member of the bi-directional loops are preferably constructed of the same material wherein the first strap member and the second strap member are sandwiched between a top strap member and the bottom strap member of the two-ply strap member, and preferably are secured between the two-ply strap member by appropriate stitching. Each bi-directional loop is preferably separated from the first eye-loop end by a distance sufficient to allow each bi-directional loop to be used in conjunction with the first eye-loop end to form a snug fit about, for example, a different, standard-size pipe.

The preferred sling of the invention is also designed to eliminate the need for several slings when, for example, catching and drifting loads into position. The sling of the invention is thus designed to give maximum head room in areas where, for example, inches could determine whether or not a load can be put into position.

In using the sling of the present invention, one does not need several slings to lift and drift the load into position, as is commonly the case in the prior art approaches in actual use in the field. The invention allows the load to be kept in control at all times.

Additionally, there is no chance of a load to slip as there is during the typical changing of the rigging several times using the approaches of the prior art in use in the field. Also, there is less chance of a worker to use a chain to lift or drift a load, which is a major safety problem on construction projects.

The preferred sling of the present invention eliminates the need for, for example, temporary steel and lifting lugs in a lot of problem areas, especially where "hot work permits" are required. The invention also saves on man-hours and materials that otherwise would be required in the actual prior art systems in use in the field.

The preferred sling of the present invention is, it is believed, the safest sling to use when catching loads and drifting loads, as the sling will have the weight of the load at all times. No matter how many chain falls are used, the load will be in control at all times, because the user never has to change slings, as in the prior art, but only change the rigging points on the sling of the present invention.

The sling of the present invention can be designed to fit any rigging need. The weight and type of load will determine the specifics of the sling, with many situations calling for standard sized slings. The tail length, that is, the length from the last bi-directional loop to the end of the sling can be changed to a longer length to drop the load(s) to any elevation(s) required, or, alternatively, a standard size sling can be used and appropriately shackled.

The preferred sling system for suspending in tandem a plurality of work pieces of the present invention comprises—a plurality of attachment devices; a main lifting sling having a plurality of spaced loops coupled thereto wherein a respective of the plurality of loops has coupled thereto a respective one of the plurality of attachment devices; and a plurality of secondary sling members for closed loop lifting of a respective one of the plurality of work pieces wherein a respective one of the plurality of second sling members is couplable to the respective one of the plurality of attachment devices.

In the preferred embodiment, each of the plurality of attachment devices is a hook member and each of the plurality of secondary sling members are wire cable slings or a sling of the present invention having a plurality of spaced, bi-directional loops. Furthermore, it is preferred that the, spacing between each loop of the plurality of loops is at least about seven (7') feet.

The preferred method of suspending in tandem a plurality of work pieces to lift simultaneously the plurality of work pieces comprises the steps of—(a) providing a main lifting sling comprising a strap member having an eye-loop end and a plurality of spaced loops having a predetermined distance therebetween and having coupled thereto an associated attachment device; (b) providing a plurality of secondary sling members for coupling thereto a respective one of the plurality of work pieces in a closed lifting loop manner; (c) coupling a respective one of the plurality of secondary sling members to a respective one of the plurality of spaced loops via the associated attachment device; and (d) exerting a force on the main lifting sling via the eye-loop end sufficient to lift the heavy pipe or the heavy load.

The sling systems of the present invention are designed to lift a plurality of heavy pipes or other heavy loads. A main lifting sling is used, having a plurality of spaced bi-directional loops, for suspending in tandem therefrom a plurality of heavy pipes or other heavy objects. Each heavy pipe or her heavy load has coupled thereto a respective secondary sling member in a closed lifting loop manner. Each secondary sling member suspends its heavy pipe or heavy load from a respective bi-directional loop.

The sling system of the present invention for suspending in tandem therefrom a plurality of heavy pipes or other heavy objects comprises a main lifting sling wherein the main lifting sling is essentially the same as the sling described above except that the first eye-loop end is omitted and the spacing between any two bi-directional loops is at least about seven (7') feet. Furthermore, each of the bi-directional loops have coupled thereto an eyelet of a hook means. Nevertheless, in lieu of bi-directional loops, single-direction eye-loops may be substituted.

The spacing of at least about seven (7') feet serves to space each tandemly suspended heavy pipe or other heavy load or other heavy object a sufficient distance from adjacent tandemly suspended heavy pipes or other heavy loads to significantly minimize if not eliminate the possibility of the heavy pipe or other heavy load from contacting an above or below adjacent heavy pipe or load if such heavy pipe or other heavy load would seesaw while tandemly suspended from its respective loop.

The sling system for suspending in tandem a plurality of heavy pipes or other heavy objects of the present invention is capable of suspending individually and simultaneously a plurality of heavy pipes or other heavy loads via a secondary sling member such as, without limitation, a flexible wire cable sling, the sling described above or any other sling capable of closed loop lifting of a heavy pipe or other heavy loads.

The preferred sling systems of the present invention, which are capable of simultaneously lifting, serve to significantly minimize the man hours and operation costs associated with the use of a lifting device, such as, without limitation, a crane. More specifically, the preferred sling systems of the present invention are capable of simultaneously lifting at least four (4) heavy pipes or other heavy loads thereby the time associated in lifting and carrying a plurality of heavy pipes or other heavy loads is significantly reduced.

It is thus a basic object of the present invention to provide a flexible, fabric sling which can be readily used with many, differently sized, heavy loads or pipe circumferences, which is very safe and can be used in close-quarters type situations. The terms heavy pipe and or heavy loads will sometimes hereinafter be referred to as a "work piece."

It is also an object of the invention to provide a sling for lifting a work piece which is adjustable to fit about a variety of different sized work pieces.

It is a further object of the present invention to provide a sling for lifting a work piece that includes a plurality of bi-directional loops along its length to adapt a portion of the sling to snugly fit about a variety of different sized work pieces in a closed lifting loop.

It is a still further an object of the present invention to provide a method for lifting a work piece in conjunction with a strap lift or sling with a spaced series of bi-directional loops.

It is a still further object of the present invention to provide a sling having a plurality of two-ply regions and a plurality of three-ply regions wherein the three-ply regions serve to eliminate twisting and turning, longitudinally, of the sling strap member of the sling and the two-ply regions serve to allow the sling strap member to be easily wrapped around the circumference of a work piece for closed loop lifting.

It is a still further object of the present invention to provide a sling having a plurality of two-ply regions and a plurality of three-ply regions and two-ply bi-directional loops to enhance the durability of the sling and, thereby, the useful life of the sling is extended.

It is a still further object of the present invention to provide a bi-directional loop which enhances the control of the sling when pulled in any or either longitudinal direction via a bi-directional loop.

It is a still further object of the present invention to provide a sling with a plurality of bi-directional loop wherein the bi-directional loop design serves to distribute suspension stress in two opposite directions, longitudinally along the length of the sling when used to complete the closed lifting loop, and serves to distribute pulling forces in two opposite directions, longitudinally, when used to pull the sling in a desired direction.

It is a still further object of the present invention to provide a sling which receives an attachment device, such as, without limitation, a shackle, for selectively attaching the first eye-loop end to one of the plurality of bi-directional loops. The attachment device has a first portion disposed through one of the plurality of bi-directional loops when the first eye-loop end is attached to one of the plurality of bi-directional loops.

Each of the plurality of bi-directional loops is preferably spaced a different predetermined distance from the first eye-loop end in a manner such that the sling may be placed snugly about a variety of different sized work pieces when the first eye-loop end is attached to a selected one of the plurality of bi-directional loops.

It is alternatively preferred that between about one and six (~1–6") inches of the ends of the first strap member and the second strap member of each of the bi-directional loops is secured between the top strap member and the bottom strap member of the two-ply strap member.

In a still further aspect of the invention, a special method of lifting a work piece is provided.

It is thus an object of the present invention to provide a method of, and sling system for, suspending in tandem a plurality of heavy pipes or other heavy loads to lift simultaneously a plurality of heavy pipes or other heavy loads.

It is thus an object of the present invention to provide a method of and sling system for, suspending in concatenation the plurality of heavy pipes or other heavy loads to lift simultaneously plurality of heavy pipes or other heavy loads.

A still further object of the invention is to provide a method of and sling system for lifting simultaneously a plurality of heavy pipes or other heavy loads.

In view of the above, it is a feature of the present invention to provide a sling which is relatively simple and inexpensive to manufacture.

Another feature of the present invention is to provide a sling which is relatively simple to use.

A further feature of the present invention is to provide a main lifting sling which is relatively simple and inexpensive to manufacture.

The above and other objects and features will become apparent from the drawings, the description given herein, the abstract and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers, and wherein:

FIG. 1 is a side, edge view of a first, preferred, exemplary embodiment of the sling having at least one of the bi-directional loops of the present invention; while

EXEMPLARY MODES OR CARRYING OUT THE INVENTION

Figure 1:
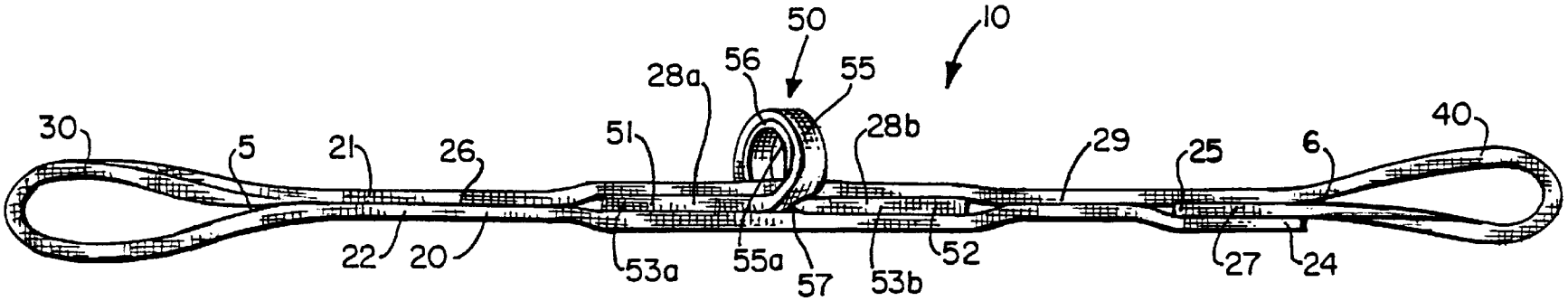
Figure 2:
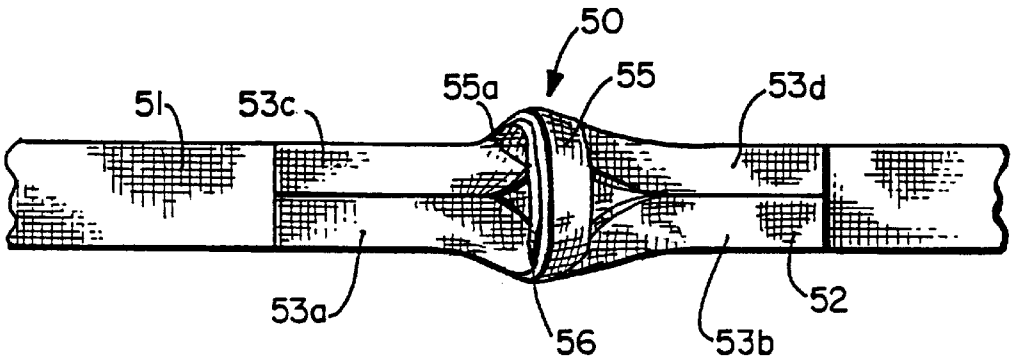
FIG. 2 is a top, partial view of the bi-directional loop of the embodiment of the sling of FIG. 1, with the top layer of the strap cut away to show the laterally spaced and longitudinally opposed, intermediately placed, bi-directional loop layer ends, which are sandwiched between the upper (unseen) and lower layers of the strap's main body.

Referring now to the drawings, and in particular to the side view of FIG. 1, the first, exemplary, preferred sling of the present invention is designated generally by the numeral 10. The sling 10 is generally comprised of a two-ply sling strap member 20, a first terminal, eye-loop end 30, a second, terminal eye-loop end 40 and at least one bi-directional loop 50 located intermediate the terminal ends.

The two-ply sling strap member 20 preferably comprises a single, integral, strap piece over-lappingly converging upon itself to form a top or upper strap member 21 and a bottom or lower strap member 22. The two-ply sling strap member 20 comprises, for example, a two (2") inch wide, strap made of flexible material such as, without limitation, woven nylon. The ends of the single strap of the two-ply sling strap member 20 comprise a first strap end 24 and a second strap end 25.

As the single strap over-lappingly converges upon itself, a first eye-loop end 30 is formed and immediately adjacent to the first eye-loop end 30, a two-ply end region 26 is formed having a first predetermined length. The first strap end 24 over-lappingly extends in the direction of the second strap end 25 such that the top strap member 21 and the bottom strap member 22 are parallel and generally are in face-to-face, flat engagement.

The second strap end 25 overlaps upon itself such that the second strap end 25 is sandwiched between the top strap member 21 and the bottom strap member 22. Thereby, the second eye-loop end 40 is formed and immediately adjacent the second eye-loop end 40, a three-ply end region 27 having a second predetermined length is formed.

The first eye-loop end 30 and the second eye-loop end 40 are each two-ply eye-loops wherein the width of the portions of the single strap forming first eye-loop end 30 and second eye-loop end 40 are essentially folded in half along the length of first eye-loop end 30 and second eye-loop end 40, respectively. The folded portion of the first eye-loop 30 is secured together via stitching to form a two-ply first eye-loop 30 and the folded portion of the second eye-loop 40 is secured together via stitching to form the two-ply, second eye-loop 40.

Between the two-ply end region 26 and the three-ply end region 27, the two-ply strap member 20 has coupled thereto the at least one, bi-directional loop 50. The bi-directional loop 50 comprises a first strap member 51 looped into an arch shape and a second strap member 52 looped into an arch shape wherein the ends 53*a* and 53*b* of the first strap member 51 and the ends 53*a*' and 53*b*' of the second strap member 52 extend in opposite directions, longitudinally, parallel to and are sandwiched between the top strap member 21 and the bottom strap member 22 of the two-ply sling strap member 20. The ends 53*a* and 53*b* of the first strap member 51 and the ends 53*a*' and 53*b*' of the second strap member 52 sandwiched between the top strap member 21 and the bottom strap member 22 form a first three-ply region 28*a* and second three-ply region 28*b*.

The arch portion 55 of the first strap member 51 and the arch portion 55' of the second strap member 52 overlap upon the top side the top strap member 21 in close proximity to each other such that the arch portion 55 of the first strap member 51 and the arch portion 55' of the second strap member 52 become essentially over-lappingly parallel. The over-lappingly parallel portion of arch portion 55 of the first strap member 51 and the arch portion 55' of the second strap member 52 are secured together, preferably, via stitching to form a two-ply closed loop member 56.

The top strap member 21 and the bottom strap member 22 having sandwiched therebetween the ends 53*a* and 53*b* of the first strap member 51 and the ends 53*a*' and 53*b*' of the second strap member 52 are sewn together from the beginning of the two-ply end region 26 and along the length of the ends 53*a* and 53*b* of the first strap member 51 and from the beginning 6 of the three-ply end region 27 and along the ends 53*a*' and 53*b*' of the second strap member 52, wherein a gap 57 exists between the top strap member 21 and the bottom strap member 22 in that region where arch portion 55 of the first strap member 51 and the arch portion 55' of the second strap member 52 overlap upon the top side the top strap member 21.

The gap 57 provides a break between the first three-ply region 28*a* and the second three-ply region 28*b* formed by the ends 53*a* and 53*b* of the first strap member 51 and the ends 53*a*' and 53*b*' the second strap member 52. The break allows the second and third three-ply regions 28*a* and 28*b* to conform more easily to the outer circumferential perimeter of the heavy pipe or other heavy object. The distance between the distal ends of ends 53*a*' and 53*b*' of the second strap member 52 and the end of the three-ply end region 27 provides a first two-ply region 29.

Referring still to FIG. 1, the method of manufacturing the sling 10 of the present invention preferably comprises—(a) providing a single strap having a first length defined between a first end 24 and a second end 25; (b) over-lappingly converging a portion of the first length of the single strap upon itself to form a top strap member 21 and a bottom strap member 22, wherein the first end 24 and the second end 25 are in close proximity; (c) forming a first eye-loop end 30; (d) forming a two-ply end region 26 adjacent the first eye-loop end 30 having a first predetermined length; (e) distributing at least one bi-directional loop 50 between the two-ply end region 26 and the three-ply end region 27 wherein the distance between the first eye-loop end 30 and the at least one bi-directional loop 50 has a length capable of wrapping around a work piece having a circumference; (f) forming a second eye-loop 40 wherein the second end 25 is looped wherein a portion of the top strap member 21 is sandwiched between a portion of the top strap member 21 and a portion of the second strap member 22 and wherein the formation of the second eye-loop 40 forms a three-ply end region 27 having a predetermined length; and (g) securing the top strap member 21 and the bottom strap member 22 having coupled thereto the at least one bi-directional loop 50.

Step "c" further preferably comprises the sub-steps of—(i) folding the width of the portion of the single strap forming the first eye-loop end 30 essentially in half; and (ii) securing the folded portion of the first eye-loop end 30 together to form a two-ply first eye-loop end 30. Step "f" further preferably comprises the sub-steps of—(i) folding the width of the portion of the single strap forming the second eye-loop end 40 essentially in half; and (ii) securing the folded portion of the second eye-loop end 40 together to form a two-ply second eye-loop end 40.

Distributing step "e" preferably comprises the steps of—(i) providing a first strap member 51 having a width which is half the width of said single strap; (ii) providing a second strap member 52 having a width which is half the width of said single strap; (iii) arching the first strap member 51 to form ends 53*a* and 53*b* having a predetermined length and an arch portion 55; (iv) arching the second strap member 52 to form ends 53*a*' and 53*b*' having a predetermined length and an arch portion 55'; (v) overlapping, parallelly, the arch portion 55 of the first strap member 51 and the arch portion 55' of the second strap member 52; (vi) securing together the overlapping, parallelly, arch portion 55' of the first strap member 51 and the arch portion 55' of the second strap member 52 to form a two-ply closed loop member 56; (vii) sandwiching the ends 53*a* and 53*b* of the first strap member 51 and the ends 53*a*' and 53*b*' of the second strap member 52 between the top strap member 21 and the bottom strap member 22; (viii) looping the two-ply closed loop member 56 over the top side of the top strap member 21; and (ix) securing the ends 53*a* and 53*b* of the first strap member 51 and the ends 53*a*' and 53*b*' of the second strap member 52 to the top strap member 21 and the bottom strap member 22.

The sandwiching step "vii" preferably comprises the sub-steps of—(a1) parallelly aligning the ends 53*a* and 53*b* of the first strap member 51 in side-by-side, parallel alignment with each other in a first direction wherein the longitudinal length of the ends 53*a* and 53*b* of the first strap member are parallelly aligned with the top strap member 21 and the bottom strap member 22; and (a2) parallelly aligning the ends 53*a*' and 53*b*' of the second strap member 52 in side-by-side parallel alignment with each other in a second direction wherein the longitudinal length of the ends 53*a*' and 53*b*' of the second strap member 52 are parallelly aligned with the top strap member 21 and the bottom strap member 22.

Thus, in summary and again with reference particularly to the side view of FIG. 1, the main body of the strap 10 is formed of a single, integral length of fabric strapping material, starting at one end at, for example, terminal end 24, extending along the full length of the strap as the lower layer 22, doubled back unto itself forming the terminal end loop 30 and extending back in flat, face-to-face relationship at top layer 21 unto and across the length of the bottom layer 22 [initially forming a two (2) layer region], with a final doubling back unto itself to form the other terminal end loop 40, then terminating in the end tip terminal piece 25 [forming a three (3) layer region]. Spaced intermediate to and between the end loops 30 & 40 is the bid-directional, double layer loop 50, with one end 51 of an initial loop layer of the bi-directional loop being laid down in one longitudinal direction and the other end 52 of the other loop layer laid down pointing in the other, opposite, longitudinal direction [each end forming a three (3) layer region with and between the upper and lower layers 21 & 22], with like three (3) layer regions being formed with the other, opposed ends of the loop layers 55, 55' on the other side of the strap (i.e., the opposite side unseen in FIG. 1) forming two sets of parallel aligned, oppositely directed, bi-directional, over-lapping, joined loop sections 55 & 55' [forming two (2) layer regions in the external loop 50 and three (3) layer regions with the main body layers 21 & 22]. All of the multi-layer regions [whether two (2) or three (3) layer regions] are sewn or otherwise attached and joined together in extended, over-laid or over-lapping, face-to-face, flat relationship to form the over-all high-strength, integrated strap structure 10.

Because of the opposed, flatly face-to-face joined, directionality of the bi-directional loop ends 51 & 52 and their related three (3) layer regions (and the analogous loop layer ends on the opposite side), regardless of which way the loop 50 is pulled, the restraining force of the loop attachment is sufficiently strong, allowing the loop to be pulled in either longitudinal direction without any diminished strength. This is in contrast to the uni-directional type of loop attachment illustrated in the exemplary embodiments of the inventor's '011 patent referred to above.

Figure 3:
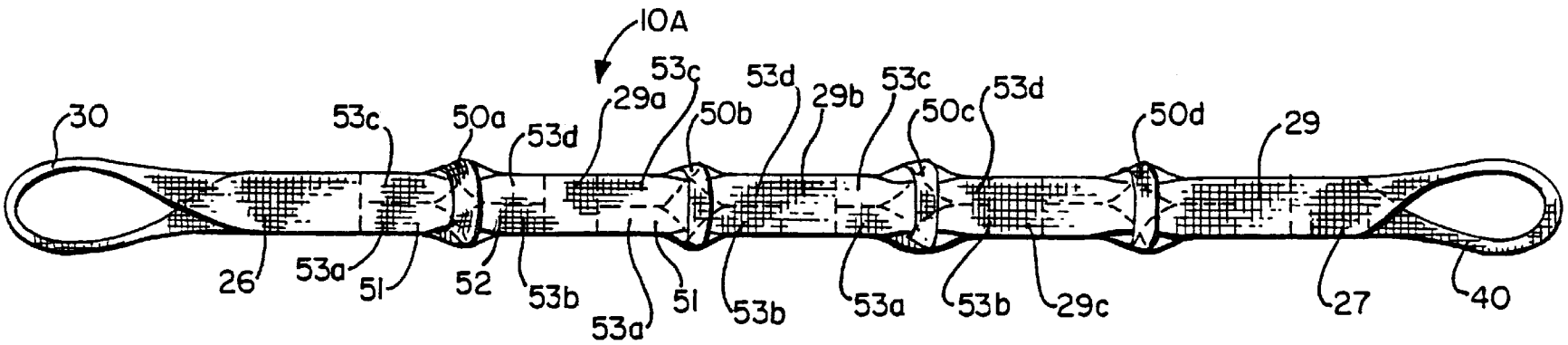
FIG. 3 is a top view of a second, exemplary embodiment, equally preferred, of the sling of the present invention having a plurality of the bi-directional loops of the present invention.

Referring now to FIG. 3, sling 10A differs from sling 10 in that a plurality of bi-directional loops 50*a*, 50*b*, 50*c* and 50*d* are provided. In the exemplary embodiment only four (4) bi-directional loops are shown. However, any number of bi-directional loops may be provided. The ends 53*b* ' and 53*d*' of the second strap member 52 the first bi-directional loop 50*a* is spaced a predetermined length from the ends 53*a* and 53*c* of the first strap member 51 of the second bi-directional loop 50*b*, thereby forming a second two-ply region 29*a*. Likewise, the ends 53*b*' and 53*d*' of the second strap member 52 of the second bi-directional loop 50*b* is spaced a predetermined length from the ends 53*a* and 53*c* of the first strap member 51 of the third bi-directional loop 50*c*, thereby forming a third two-ply region 29*b* and so on and so forth. However, the spacing between the plurality of bi-directional loops 50*a*, 50*b*, 50*c* and 50*d* allows sling 10A to accommodate a variety of circumferences of heavy pipe 1 or other heavy objects. Each of the bi-directional loops 50*a*, 50*b*, 50*c* and 50*d* is preferably spaced a predetermined distance from the first eye-loop end 30 in a manner such that the sling 10A may be placed snugly about a variety of different sized, heavy pipes 1 or other heavy objects or loads.

Figure 6:
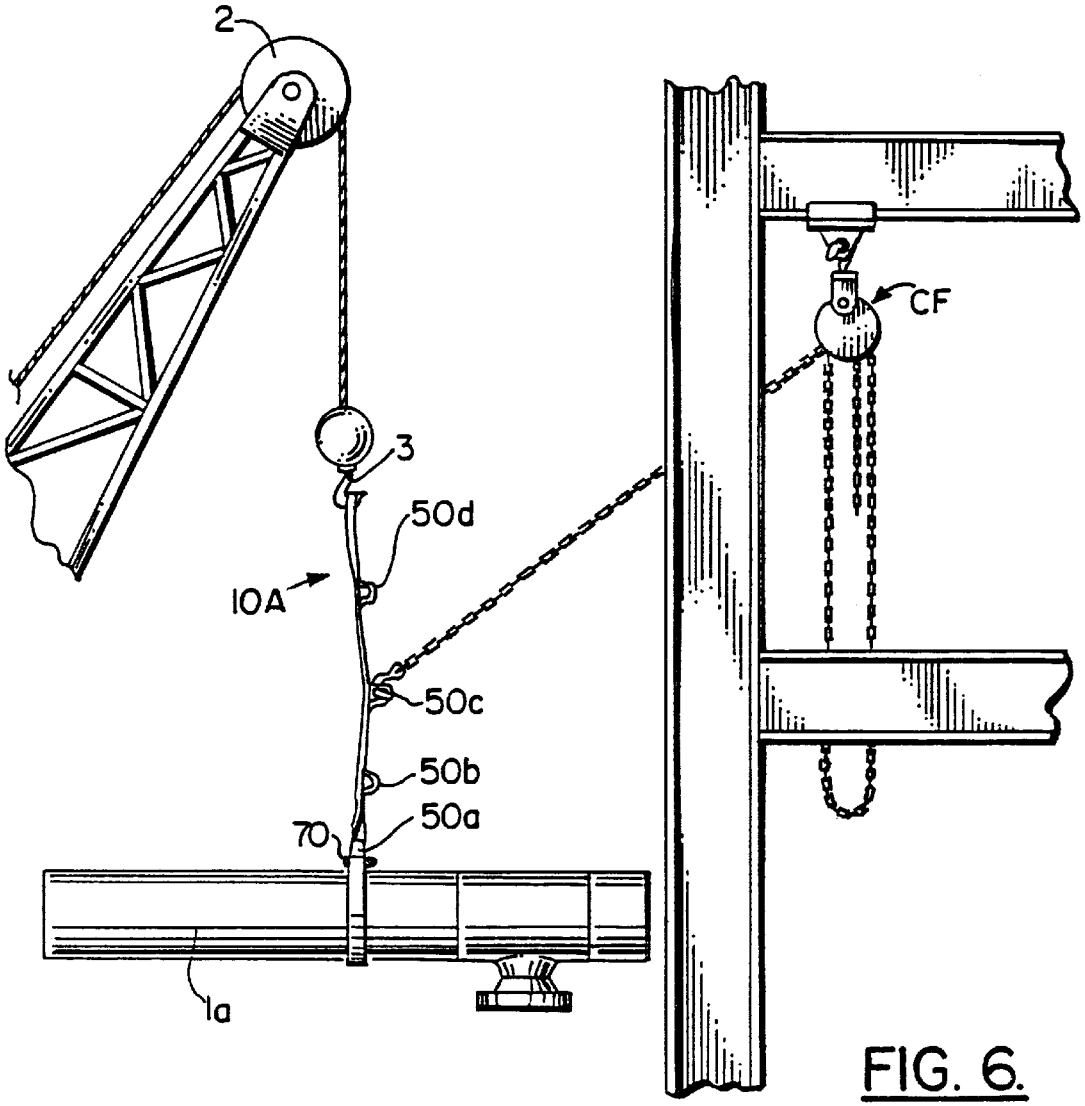
FIG. 6 is a further, simplified representation of a different, exemplary method of crane hoisting and initial lateral movement of a heavy pipe as an exemplary work piece, using the multi-loop sling embodiment of FIG. 3.
Figure 5:
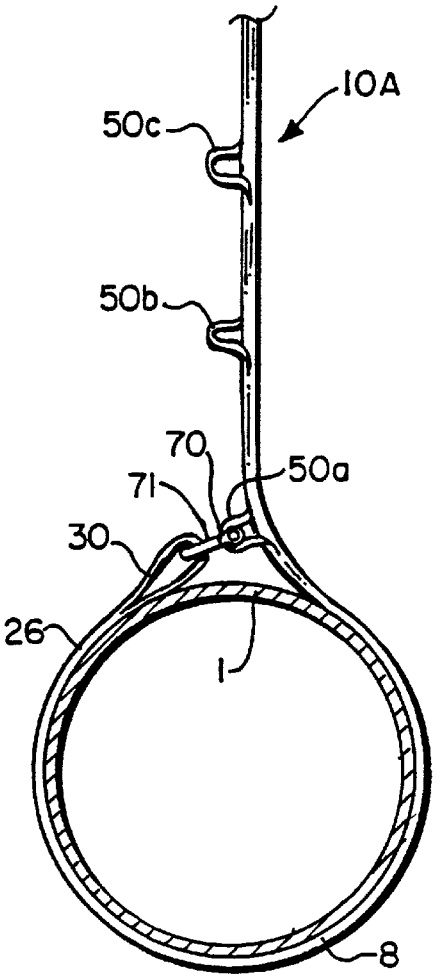
FIG. 5 is a simplified representation showing in an end view a preferred method of securing the strap sling about an exemplary pipe load (in cross-section), using the multi-loop sling embodiment of FIG. 3.

The bi-directional loop 50 or the respective one of the plurality of bi-directional loops 50*a*, 50*b*, 50*c* and 50*d* used to complete the closed lifting loop 8, as best seen in FIG. 5, of the present invention serves to distribute into two opposite directions, longitudinally, along the sling 10 or 10A, the suspension stress of a heavy pipe 1 or other heavy load. Furthermore, one of the plurality of bi-directional loops 50*a*, 50*b*, 50*c* and 50*d* along the length of the sling 10A between the closed lifting loop 8 and the second eye-loop end 40 can be hooked via a second lifting device or chain fall "CF" to pull the sling 10A in a desired direction, as best seen in FIG. 6 (also note FIG. 10 of the prior patent U.S. Pat. No. 5,688,011). As the second lifting device or chain fall "CF" pulls the sling 10A in the desired direction, the bi-directional loops 50*a*, 50*b*, 50*c* or 50*d* distributes the pulling forces exerted thereto into opposite directions along the sling strap member 20, thereby maneuverability of the heavy pipe 1 or other heavy load, while suspended, in different directions, i.e., side-to-side or up or down, is enhanced.

Referring still to FIG. 3, the preferred method of manufacturing sling 10A comprises the steps set forth above in relation to FIG. 1 wherein the step of (e) is repeated for each of the remaining plurality of bi-directional loops 50*b*, 50*c* and 50*d* wherein each of the remaining plurality of bi-directional loops 50*b*, 50*c* and 50*d* are spaced a predetermined distance between the other to form a two-ply region 29*b*, 29*c* between any two adjacent bi-directional loops and wherein the two-ply regions 29*b*, 29*c* have a predetermined length.

Figure 4:
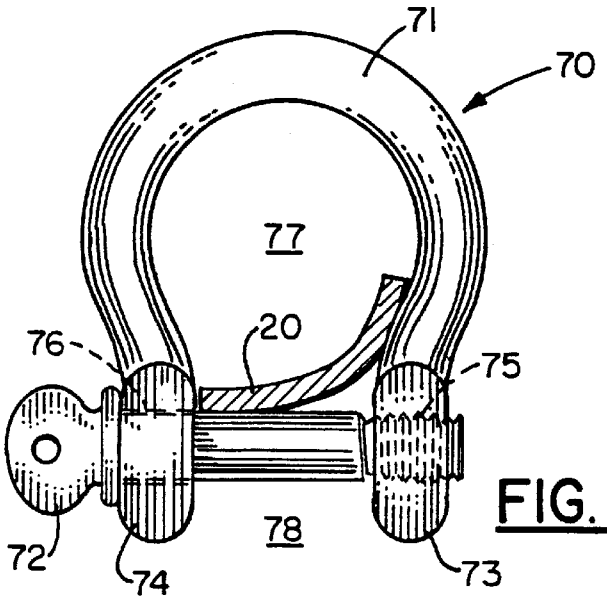
FIG. 4 is a side view of a typical, exemplary shackle for use in lifting and hoisting operations in association with the sling embodiments of FIGS. 1 & 3.

FIG. 4 depicts an exemplary attachment device for selectively attaching the first eye-loop end 30 to the at least one bi-directional loop 50 or to one of the plurality of bi-directional loop 50*a*, 50*b*, 50*c* and 50*d*. The attachment device shown in FIG. 4 is a typical shackle 70. However, it is noted that typically a shackle or other, separate, attachment device is not needed, and, in most situations, the distal end of the main body of the sling 10 merely is inserted through an appropriately selected, intermediate loop 50*a*–50*d* that is the loop located in a position which causes the looped part of the sling to best over-approximate or equal the circumference of the heavy load about which the sling is being looped.

As shown, the typical shackle 70 includes a shackle bar 71 and a shackle pin 72. The shackle bar 71 has first and second shackle-end 73, 74, respectively, that has been bent to form a central opening 77 which is accessible through a throat opening 78.

Each of the first and second shackle-ends 73, 74 has an aperture 75, 76, respectively, there through of a size sufficient to receive therein a portion of the shackle pin 72. The throat opening 78 of the typical shackle 70 is smaller than the width of the two-ply strap member 20.

Referring now to FIG. 5, in operation, the sling 10A is secured around the heavy pipe 1 or other heavy load by forming a closed lifting loop 8. The closed lifting loop 8 is formed by wrapping the first eye-loop end 30 and the first two-ply region 26 around the outer circumferential perimeter of the heavy pipe 1 or other heavy load, wherein, preferably, the top side the top strap member 21 is in surface-to-surface contact with the outer circumferential perimeter of the heavy pipe 1 or other heavy load.

The first eye-loop end 30 is secured via a attachment device, such as, without limitation, a shackle 70 to one of the plurality of bi-directional loop 50*a*, 50*b*, 50*c* and 50*d*. Thereafter, second eye-loop end 40 may be secured to a lifting device 2, as shown in FIG. 6.

FIG. 5 shows sling 10A in position about a heavy pipe 1 having an external diameter of about twelve (12") inches. The sling 10A is attached about heavy pipe 1 by placing the top side of top strap member 21 about the exterior circumference of heavy pipe 1, placing the shackle bar 71 through first eye-loop end 30 and bi-directional loop 50*b*, and inserting the shackle pin 72 into the apertures 75, 76.

FIG. 6 shows the sling 10A in use lifting a heavy pipe 1A, such as, for example, a pipe section. As shown in the figure, the plurality of bi-directional loops 50*a*, 50*b*, 50*c* and 50*d* may also be used as locations for one or more guide line attachments, as well as for passing the heavy pipe 1A along a series of block and to tackle assemblies.

While not shown, in operation, the sling 10 is secured around the heavy pipe 1 or other load by forming a closed lifting loop 8 in the manner described above in relation to sling 10A. Thereafter, second eye-loop end 40 may be secured to the lifting device 2. If the sling 10 is provided with only one bi-direction loop 50, the spacing of bi-directional loop from first eye-loop end 30 is defined to accommodate one particular industry specific heavy pipe circumference.

FIG. 6 illustrates exemplary sling 10A snugly attached to the heavy pipe 1A. An exemplary pipe load, such as that illustrated, weighs, for example, hundreds of pounds or more.

With reference to sling 100 of FIG. 10 of the previous '011 patent, sling 10A can like wise be coupled to chain hooks, which are re attached to (i.e. hooked into) appropriately selected bi-directional loops (e.g. bi-directional loops 50*c* & 50*d*) for appropriately manipulating the slings 10A and the heavy pipe 1*a*.

While not shown, more than one sling 10A may be used to catch and drift loads, the load is picked up typically with some type of lifting device 2, such as, a crane. The lifting device 2, a crane, supported load (e.g. pipe 1*a*) is swung as close to the structure as possible and the weight can be caught and the crane released by hooking the chain-fall "CF" into one of the plurality of bi-directional loops.

The arrangement pulls sling 10A with one chain-fall "CF" to the location needed, the second chain-fall "CF" will hold back, allowing the load to be controlled to a certain elevation and level and, also, this helps control the speed at which the load will move so there is no or at least diminished danger in damaging existing structures or materials. The number of chain-falls "CF" to be used will be determined by the distance the load has to travel, and the chain-falls "CF" are placed at different locations for the best routing of the load.

The user moves the load from one chain-fall "CF" to the next one—until it has reached, for example, the point of installation.

An exemplary method of lifting a heavy pipe 1 or other heavy object (work piece) is now described with general reference to FIGS. 1–6. The preferred method comprises the following steps—(a) providing a sling 10 or 10A, and an attachment device, preferably, a shackle 70 (both as herein above described); (b) wrapping the first eye-loop end 30 about the circumference of a work piece in a manner such that the top side of the top strap member 20 is in surface-to-surface contact with the work piece; (c) attaching first eye-loop end 30 to the at least one bi-directional loop 50 or one of the plurality of bi-directional loops 50*a*, 50*b*, 50*c* and 50*d* with preferred shackle 70; and (d) exerting a force on the sling 10 or 10A sufficient to lift the work piece via the second eye-loop end 40 or one of the plurality of bi-directional loops 50*a*, 50*b*, 50*c* and 50*d*.

Alternatively, in lieu of the shackle 70, hooks or other implements call be attached, in similar fashion.

Figure 7:
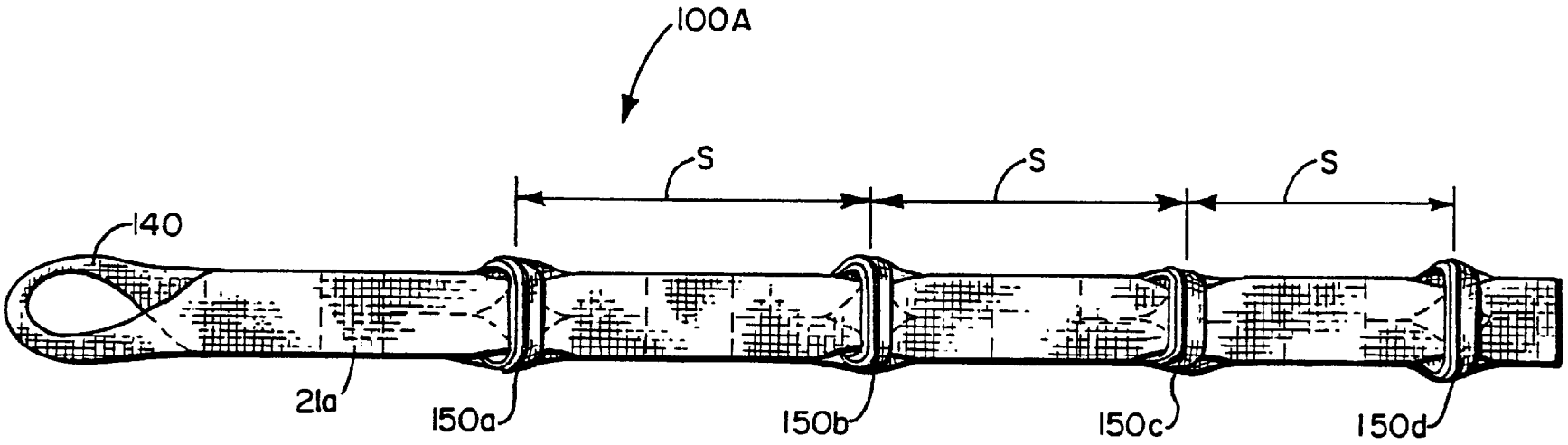
FIG. 7 is a top view of an alternative, main lifting sling of the preferred, exemplary sling system of the present invention.
Figure 8:
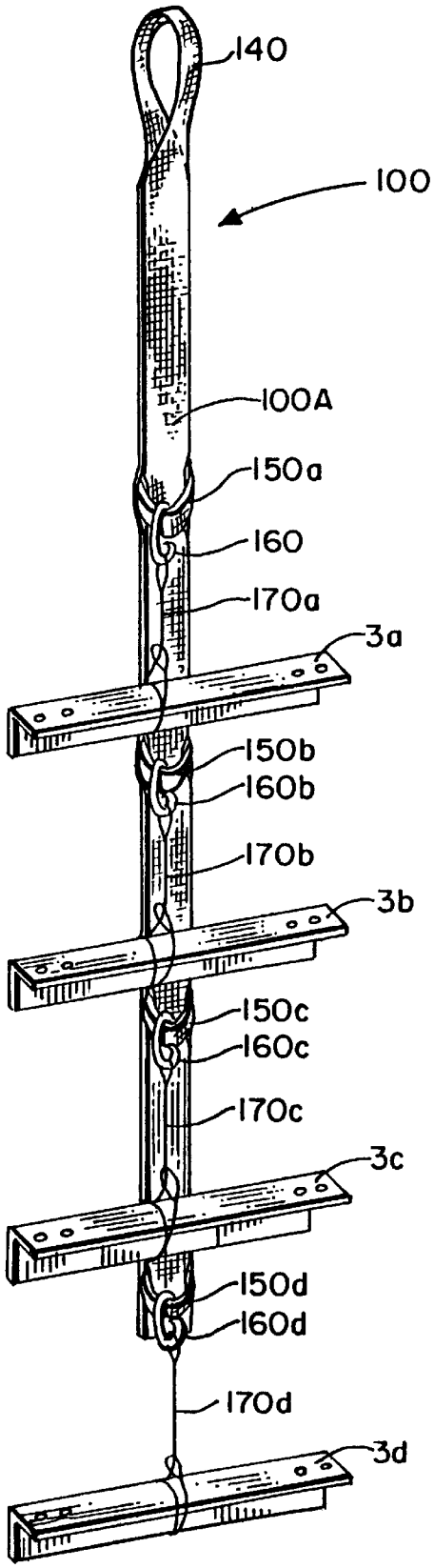
FIG. 8 is a perspective view of a further, alternative, exemplary sling system of the present invention, illustrating an exemplary method of tandemly suspending individually and simultaneously a plurality of heavy pipe, work pieces or other heavy loads using the main lifting sling of the embodiment of FIG. 7.

Referring now to FIGS. 7 and 8, the sling system 100 of the present invention comprises a main lifting sling 100A having a plurality of loops 150*a*, 150*b*, 150*c* and 150*d* coupled thereto a respective one of a plurality of attachment devices, preferably, hook members 160*a*, 160*b*, 160*c* and 160*d* and a plurality of secondary sling members 170*a*, 170*b*, 170*c* and 170*d* capable of closed loop lifting. The plurality of second sling members 170*b*, 170*c* and 170*d* comprise wire cable slings or slings 10 or 100A described above in relation to FIGS. 1 and 3. The sling system 100 suspends in tandem a plurality of heavy pipes or other heavy loads 3 to lift simultaneously the plurality of heavy pipes or other heavy loads 3.

Preferably, the plurality of loops 150*a*, 150*b*, 150*c* and 150*d* are bi-directional loops described above in relation to FIGS. 1 and 3. Furthermore, main lifting sling 100A has a plurality of two-ply regions and a plurality of three-ply regions as also described above in relation to FIGS. 1 and 3. Main lifting sling 100A differs from sling 10A in that main lifting sling 100A has one eye-loop end 140, and the spacing "S" between the closed arch loops of the bi-directional loops is at least about seven (7') feet.

Since each of the heavy pipes or other heavy loads 3 have a long length, when the heavy pipes or other heavy loads 3 are suspended via the plurality of second sling members 170*b*, 170*c* and 170*d*, such as the heavy pipes or other heavy loads 3*a*, 3*b*, 3*c* and 3*d* may seesaw in mid-air. The spacing "S" of at least about seven (7') feet minimizes, if not eliminates, the possibility of the seesawing heavy pipes or other heavy loads 3*a*, 3*b*, 3*c* and 3*d* from contacting the suspended heavy pipe or other heavy load immediately above or below.

Referring now to FIG. 8, the preferred method of suspending in tandem a plurality of heavy pipes or other heavy loads to lift simultaneously a plurality of heavy pipes or other heavy loads comprises the steps of—(a) providing a main lifting sling 100A comprising a strap member having an eye-loop end 140 and a plurality of spaced loops 150*a*, 150*b*, 150*c* and 150*d* having a predetermined distance therebetween and having coupled thereto an associated attachment device 160*a*, 160*b*, 160*c* and 160*d*; (b) providing a plurality of secondary sling members 170*a*, 170*b*, 170*c* and 170*d* for coupling thereto a respective heavy pipe or other heavy load 3*a*, 3*b*, 3*c* and 3*d* in a closed lifting loop manner; (c) coupling a respective one of said plurality of secondary sling members 170*a*, 170*b*, 170*c* and 170*d* to a respective one of the plurality of spaced loops 150*a*, 150*b*, 150*c* and 150*d* via said associated attachment device 160*a*, 160*b*, 160*c* and 160*d*, respectively; and (d) exerting a force on the main lifting sling 100A via the eye-loop end 140 sufficient to lift the plurality of heavy pipes or heavy loads 3*a*, 3*b*, 3*c* and 3*d*.

In the preferred embodiment of the method of suspending in tandem the plurality of heavy pipes or other heavy loads, the associated attachment device 160*a*, 160*b*, 160*c* or 160*d* is a hook member having an eyelet coupled to the loop.

In the preferred embodiment of the method of suspending in tandem the plurality of heavy pipes or other heavy loads, the main lifting sling comprises a two-ply strap member having plurality of two-ply regions and a plurality of three-ply regions formed by sandwiching each of the plurality of loops sandwiched between the top strap member 21*a* and the bottom strap member (not shown) of the two-ply strap member.

Since each of the heavy pipes or other heavy loads 3*a*–*d* have a long length, when the heavy pipes or other heavy loads are suspended via the sling system, such heavy pipes or other heavy loads may seesaw in mid-air. The spacing of at least about seven (7') feet minimizes, if not eliminates, the possibility of the seesawing heavy pipes or other heavy loads from contacting the suspended heavy pipe or other heavy load immediately above or below.

The desired spacing of at least about seven (7') feet of the multi-separated-load sling system described above may be shorter provided the heavy pipe or heavy loads are shorter.

Of course the foregoing are merely exemplary of the many different ways the sling and sling systems of the present invention can be used in connection with heavy loads, such as, for example, heavy pipe sections, and the particular dimensions and sizes provided above are of course also merely exemplary and subject to great variation.

It is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A sling for lifting a heavy work piece, comprising:

a single strap made of flexible, in-elastic fabric material over-lappingly converging upon itself to form a top strap member and a bottom strap member to form a two-ply strap member;

a first, integral, terminal, eye-loop end;

a second, integral, terminal end; and at least one, intermediately spaced, bi-directional loop coupled to said two-ply strap member between said first eye-loop end and said second end, said at least one bi-directional loop being sandwiched between said top strap member and said bottom strap member.

2. The sling of claim 1, wherein immediately adjacent the first eye-loop end the two-ply strap member has a two-ply end region and immediately adjacent said second end there is a three-ply end region.

3. The sling of claim 1, wherein the at least one bi-directional loop comprises:

a first strap member looped into an arch shape and having ends; and, a second strap member looped into an arch shape and having ends wherein the ends of the first strap member and the ends of the second strap member extend in two opposite directions, longitudinally, parallel to and are sandwiched between the top strap member and the bottom strap member of the two-ply sling strap member.

4. The sling of claim 3, wherein:

the ends of the first strap member and the ends of the second strap member sandwiched between the top strap member and the bottom strap member form a first, three-ply region and a second, three-ply region, and wherein:

the arch portion of said first strap member and the arch portion of said second strap member overlap upon a top side the top strap member in close proximity to each other, the arch portion of said first strap member and the arch portion of said second strap member being essentially over-lappingly in parallel to form a two-ply, closed loop member.

5. The sling of claim 1, further including:

an attachment means for selectively attaching said first eye-loop end to said at least one bi-directional loop, said attachment means having a first portion disposed through said at least one bi-directional loop, and said first eye-loop end is attached to said at least one bi-directional loop.

6. The sling of claim 5, wherein:

a number of bi-directional loops are each spaced a different predetermined distance from said first eye-loop end in a manner such that said sling may be placed snugly about a variety of different sized work pieces when said first eye-loop end is attached to one of said number of bi-directional loops to form a closed, lifting loop, each bi-directional loop serving to distribute suspension stresses in two directions, longitudinally, along the sling when used to complete the closed lifting loop and distribute pulling forces in two directions, longitudinally, along the sling when pulled in any direction.

7. The sling of claim 1, further including:

a shackle including a shackle bar, having a first and second shackle-end, forming a central opening accessible through a throat opening; and a shackle pin, each of said first and second shackle-ends having an aperture there through of a size sufficient to receive therein a portion of said shackle pin, said throat opening being of a size sufficient to allow a section of said single strap to pass there through into said central opening.

8. The sling of claim 7, wherein:

a number of said bi-directional loops are each spaced a predetermined distance from said first eye-loop end in a manner such that the sling may be placed snugly about a variety of spaced work pieces.

9. The sling of claim 1, wherein:

said second end also includes an eye-loop end.

10. A method of lifting a heavy work piece, comprising the following steps:

a) providing a sling comprising a single strap made of flexible, in-elastic, fabric material over-lappingly converging upon itself to form a top strap member and a bottom strap member to form a two-ply strap member, a first eye-loop end, a second eye-loop end, and at least one, spaced, bi-directional loop coupled to said two-ply strap member between the first eye-loop end and the second eye-loop end, and an attachment means for selectively attaching said first eye-loop end to said at least one bi-directional loop, b) wrapping said first eye-loop end about said work piece in a manner such that a top side of the top strap member is in surface-to-surface contact with said work piece;

c) attaching said first eye-loop end to said at least one bi-directional loop with said attachment means to form a closed lifting loop; and d) exerting a force on said strap sufficient to lift said work piece.

11. The method or claim 10, wherein there is the further step in step "a" of:

including a number of bi-directional loops, each spaced a predetermined distance from said first, eye-loop end in a manner such that the sling may be placed snugly about a variety of different sized work pieces, each bi-directional loop serving to distribute suspension stresses in two directions, longitudinally, along the sling when used to complete a closed, lifting loop and to distribute pulling forces in two directions, longitudinally, along the sling when pulled in any direction; and wherein there is further included the step of:

selecting one of said number of bi-directional loops which produces the closed lifting loop having a comparable inner diameter in comparison to the outer periphery of the work piece being worked on.

12. The method of claim 10, wherein:

said at least one bi-directional loop includes
a first strap member having ends, and
a second strap member having ends; and wherein there is further included the step of:

looping said first and second strap members each into an arch shape wherein the ends of the first strap member and the ends of the second strap member extend in two opposite directions, longitudinally, parallel to and sandwiched between the top strap member and the bottom strap member of the two-ply, sling strap member.

13. The method of claim 12, wherein:

the ends of the first strap member and the ends of the second strap member are sandwiched between the top strap member and the bottom strap members forming a first, three-ply region and a second, three-ply region; and wherein there is further included the steps of:

arching a portion of the first strap member and arching a portion of the second strap member to overlap upon a top side of the top strap member in close proximity to each other the arch portion of the first strap member and the arch portion of the second strap member becoming essentially over-lappingly parallel to form a two-ply, closed loop member.

14. The method of claim 10, wherein step "c" further includes the step of:

performing said attaching step using a shackle including a shackle bar, having first and second shackle-ends, configured to form a central opening accessible through a throat opening, and a shackle pin, each of said first and second shackle-ends having an aperture there through of a size sufficient to receive therein a portion of said shackle pin, said throat opening being of a size sufficient to allow a section of said strap to pass there through into said central opening.

15. A method of manufacturing a sling, comprising the steps of:

(a) providing a single strap having a first length defined between a first end and a second end;

(b) over-lappingly converging a portion of the first length of the single strap upon itself to form a tops strap member and a bottom, strap member, with the first end and the second end being in close proximity;

(c) forming a first, eye-loop end, and forming a second end having a three-ply, end region, (d) forming a two-ply, end region adjacent the first, eye-loop end having a first predetermined length;

(e) forming at least one bi-directional loop between the two-ply, end region and the three-ply, end region wherein the distance between the first eye-loop end and the at least one bi-directional loop has a length capable of wrapping around a work piece having a circumference;

(f) forming a second eye-loop wherein the second end is looped wherein a portion of the top strap member is sandwiched between a portion of the top strap member and a portion of the second strap member, and wherein the formation of the second eye-loop forms the three-ply, end region having a predetermined length; and (g) securing the top strap member and the bottom strap member having coupled thereto the at least one bi-directional loop.

16. A method of claim 15, wherein step "c" further comprises the sub-steps of:

(i) folding the width of the portion of the single strap forming the first, eye-loop end essentially in half; and (ii) securing the folded portion of the first, eye-loop end together to form a two-ply, first, eye-loop end; and wherein step "f" further comprises the sub-steps of:

(i) folding the width of the portion of the single strap forming the second, eye-loop end essentially in half; and (ii) securing the folded portion of the second, eye-loop end together to form a two-ply, second, eye-loop end.

17. A method of claim 15, wherein forming step "e" comprises the sub-steps of:

(i) providing a first, strap member having a width which is half the width of said single strap;

(ii) providing a second, strap member having a width which is half the width of said single strap;

(iii) arching the first, strap member to form ends having a predetermined length and an arch portion;

(iv) arching the second, strap member to form ends having a predetermined length and an arch portion;

(v) overlapping, parallelly, the arch portion of the first, strap member and the arch portion of the second, strap member;

(vi) securing together the overlapping, parallelly, arch portion of the first, strap member and the arch portion of the second, strap member to form a two-ply, closed loop member;

(vii) sandwiching the ends of the first, strap member and the ends of the second, strap member between the top strap member and the bottoms strap member;

(viii) looping the two-ply closed loop member over a top side of the tops strap member; and (ix) securing the ends of the first, strap member and the ends of the second, strap member to the top strap member and the bottom strap member.

18. The method of claim 17, the sandwiching step "vii" comprises the sub-steps of:

(a1) parallelly aligning the ends of the first, strap member in side-by-side parallel alignment with each other in a first direction, wherein the longitudinal length of the ends of the first, strap member are parallelly aligned with the top, strap member and the bottom, strap member; and (a2) parallelly aligning the ends of the second, strap member in side-by-side parallel alignment with each other in a second direction, wherein the longitudinal length of the ends of the second, strap member are parallelly aligned with the top, strap member and the bottom, strap member.

* * * * *